United States Patent [19]

McIntire

[11] Patent Number: 5,037,136

[45] Date of Patent: Aug. 6, 1991

[54] BOOK STIFFENER

[76] Inventor: Lawrence D. McIntire, 717 Rutherford Dr., Chesapeake, Va. 23320

[21] Appl. No.: 506,021

[22] Filed: Apr. 9, 1990

[51] Int. Cl.[5] ..... B42D 1/00

[52] U.S. Cl. ..... 281/15.1; 281/29; 281/36; 402/73; 402/80 R

[58] Field of Search ..... 281/15.1, 29, 33, 36, 281/37; 402/73, 80 R

[56] References Cited

U.S. PATENT DOCUMENTS

| | | | |
|---|---|---|---|
| 520,171 | 5/1894 | Thompson | 281/37 |
| 861,722 | 7/1907 | Haas . | |
| 985,237 | 2/1911 | Waterhouse . | |
| 1,037,024 | 8/1912 | Krumming | 281/29 |
| 1,079,418 | 11/1913 | Krumming . | |
| 2,218,347 | 10/1940 | St. Louis | 281/33 |
| 3,224,792 | 12/1965 | Vernon | 281/33 |
| 4,315,642 | 2/1982 | Errichiello | 281/33 |
| 4,552,479 | 11/1985 | Nickow et al. | 281/33 X |

FOREIGN PATENT DOCUMENTS

| | | | |
|---|---|---|---|
| 602453 | 3/1960 | Italy | 281/33 |

*Primary Examiner*—Timothy V. Eley
*Assistant Examiner*—Willmon Fridie, Jr.
*Attorney, Agent, or Firm*—Griffin Branigan & Butler

[57] ABSTRACT

A book stiffener comprises a relatively flat, thin, elongated, ridged, rotatable strip (32) having a length dimension (38) substantially greater than a width (44) of a back binding (22) of a book cover (16) but less than a length (46) of the book cover and a width dimension which is less than the length (40) of the back binding and a swivel attachment (34, 30) for attaching the rotatable strip to a rear surface of the book cover so as to allow rotation of the rotatable strip relative to the book cover whereby the rotatable strip can be rotated to a position in which it extends across hinge seams (24, 26) of front and back flap covers (18, 20) of the book cover with the back binding off the book to thereby impinge upon the front and back flap covers to prevent them from being opened substantially beyond an approximate common plane. The rotatable strip can also be rotated to a disabled position in which it extends more nearly parallel with the back binding so as not to extend across the hinge seams and not to extend beyond edges of the book cover. In one embodiment, the book stiffener mechanism includes a relatively flat thin ridged mounting strip (30) which is fixedly attached by a self adhering adhesive (50) to the book cover and to which the rotatable strip is rotatably attached.

16 Claims, 3 Drawing Sheets

BOOK STIFFENER

BACKGROUND OF THE INVENTION

This invention relates generally to the art of books and more specifically, to books having mechanisms mounted thereon for stiffening them when they are placed in open configurations. In a sense, this invention relates to the art of lap desks.

A difficulty many people have when using books, specifically loose-leaf notebooks, is that front and back flap covers of the books usually rotate freely about hinge seams so that such books are cumbersome when held open in a lap. Similarly, it often occurs that loose-leaf notebooks, when open, extend laterally beyond small work surfaces of desks used in many schools today so that front and rear flaps thereof rotate downwardly, offering little or no support for loose-leaf papers in the notebooks. When one works with a loose-leaf notebook on his lap or at a small desk, rear and front flap covers provide little or no support but rather rotate easily about hinge seams beyond a common plane in which they are approximately parallel one with another. It is, therefore, an object of this invention to provide a book stiffener used in conjunction with a book, especially a loose-leaf notebook, for preventing front and rear flap covers from rotating substantially beyond a common plane in which they are approximately parallel with one another.

At the same time, it is an object of this invention to provide such a book stiffener which, when a book on which it is mounted, such as a notebook, is closed, will not unduly protrude, or make the book awkward to handle.

Similarly, it is an object of this invention to provide a book stiffener providing the above benefits which is inexpensive to construct and easy to mount on a book but at the same time, is quite uncomplicated to use and not unsightly in appearance.

SUMMARY

According to principles of this invention, a book stiffener, and a method of using the same, involves a relatively flat, thin, elongated, rigid rotatable strip and a swivel mechanism for rotatably attaching the rotatable strip to an outside surface of a book cover so as to allow rotation of the rotatable strip relative to the book cover. By rotating the rotatable strip, it can be placed in a stiffening position in which it extends across hinge seams of front and back flap covers with a back binding to thereby impinge upon the front and back flap covers for preventing them from being opened substantially beyond a common plane. In one embodiment the rotatable strip is attached to the back binding and in another embodiment it is rotatably attached to one of the front or back covers. In another embodiment, the book stiffener mechanism includes a mounting strip which is attached to the book cover by means of a self-adhering adhesive.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF PREFERRED EMBODIMENTS

Figure 1:
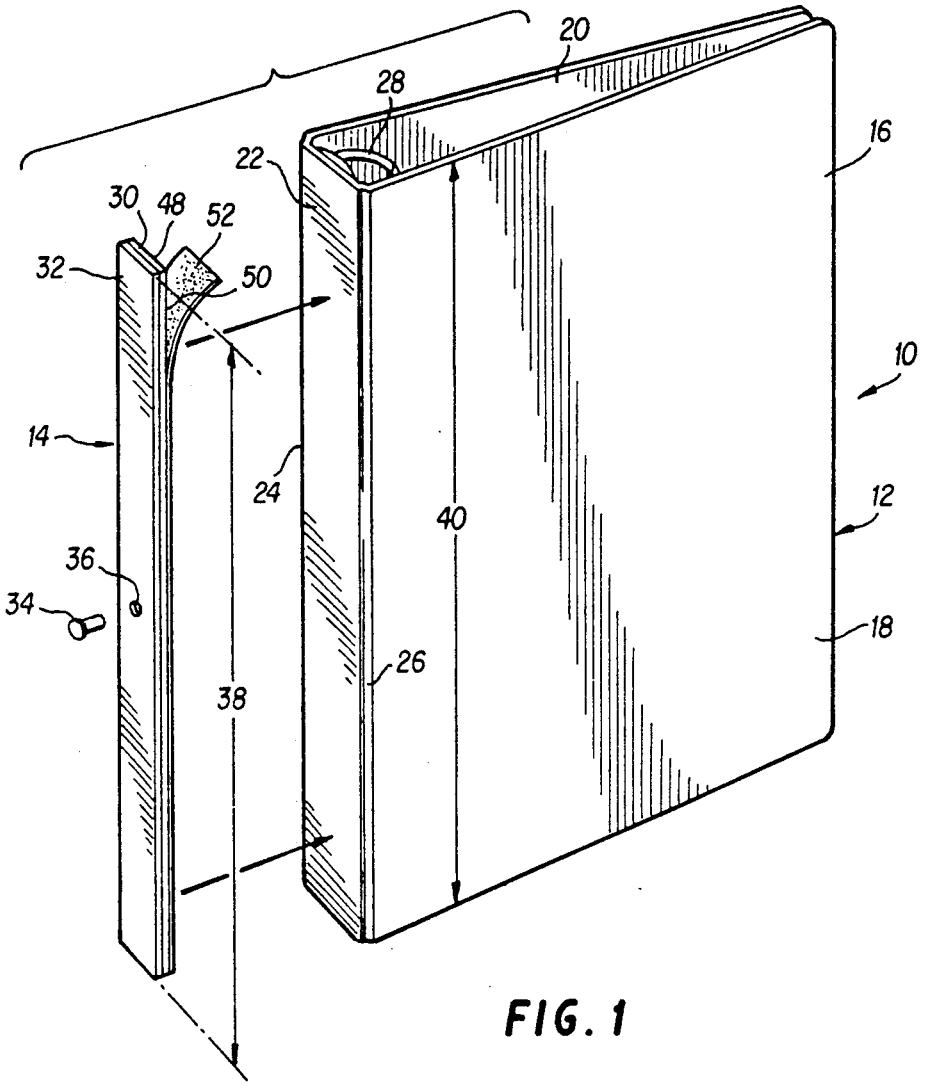
FIG. 1 is an exploded isometric view of a loose-leaf notebook with a book stiffener of this invention.

A stiffened book assembly 1 of FIG. 1 comprises a loose-leaf notebook 12 and a book stiffener mechanism 14.

The loose-leaf notebook 12 has a cover 16 which includes a front flap cover 18, a rear flap cover 20 and an elongated back binding 22. The back binding 22 is respectively attached to the front and rear flap covers 18 and 20 at hinge seams 24 and 26 which allow the respective front and rear flap covers 18 and 20 to pivot thereabout relative to the back binding 22 approximately 180° from the position shown in FIG. 1. Thus, when a user thereof opens the loose-leaf notebook 12 on his or her lap or small desk in order to write on papers 27 clipped to openable rings 28, the front and rear flap covers 18 and 20 provide little support therefor, flopping to positions rotated far beyond a plane of the back binding 22.

Figure 2:
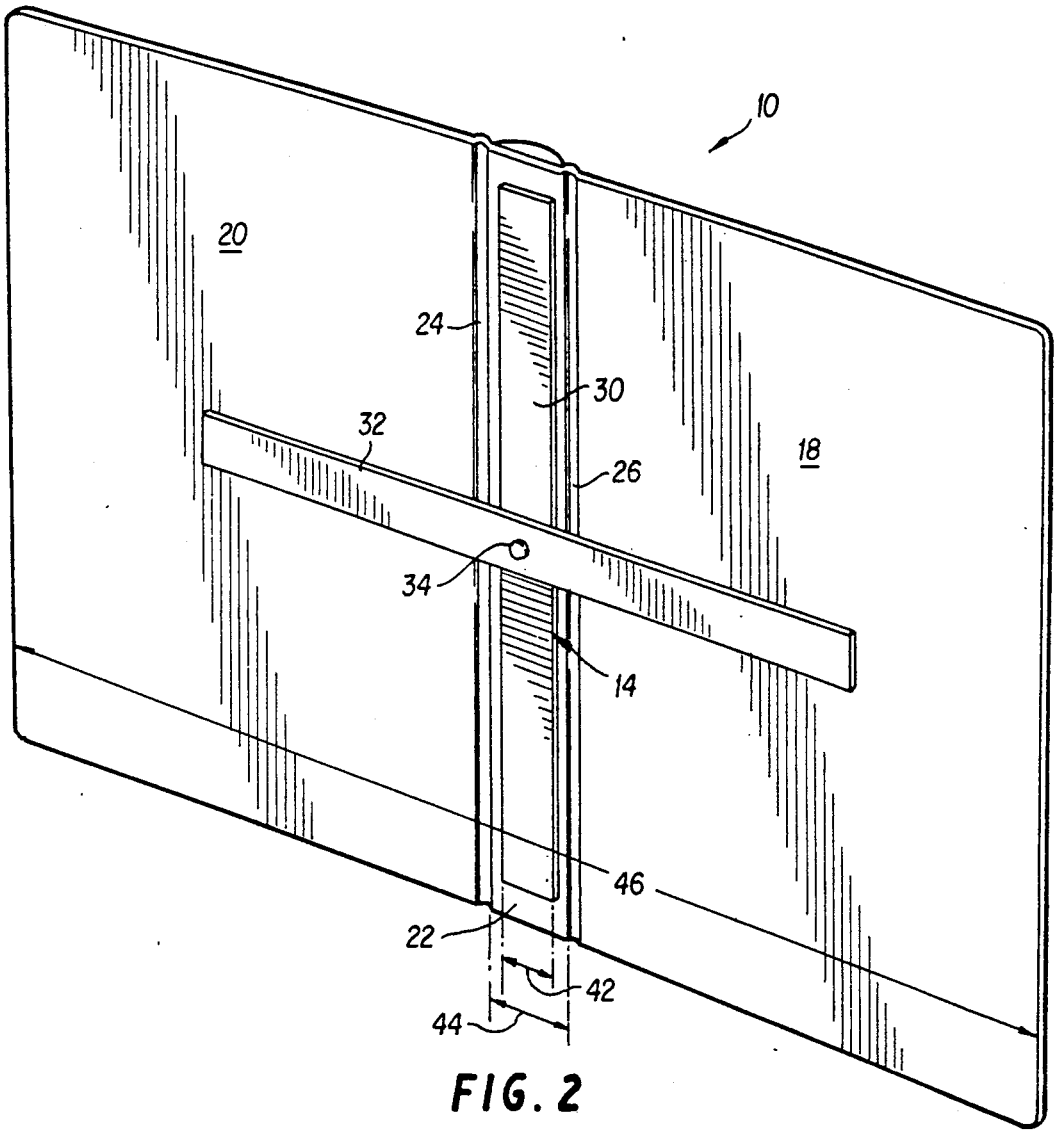
FIG. 2 is an isometric rear view of the structure of FIG. 1 with the book stiffener being attached to the notebook and being in a stiffening position.

The book stiffener mechanism 14 comprises a relatively flat, thin, elongated, ridged, mounting strip 30, a relatively flat, thin, elongated, ridged, rotatable strip 32, and a swivel attachment 34 which, in a preferred embodiment, is a rivet having a shaft passing through coincident holes 36 located approximately at midpoints of the mounting and rotatable strips 30 and 32. In this regard, once the rivet 34 is passed through the holes 36, an end thereof is flattened so as to cooperate with an opposite-end head for holding the strips together while allowing them to rotate about the rivet 34 relative to one another in approximately parallel planes. In a preferred embodiment, the mounting and rotatable strips 30 and 32 are equal in width and in length, however, this is not necessary for proper functioning of this invention. The lengths 38 of the strips 30, 32 should be less than a height 40 of the cover 16. Further, if it is intended to mount the book stiffener mechanism 14 on the back binding 22 as is depicted in FIG. 2, it is helpful if the strips 30, 32 have a width 42 which is less than a width 44 of the back binding 22. It is also helpful if the rotatable strip 32 has a length 38 which is less than a length 46 of the loose-leaf notebook 12 when it is an open configuration as is shown in FIG. 2.

The mounting and rotatable strips 30 and 32 can be constructed of the same material or different materials. Some materials which have been used include wood and rigid resinous plastics such as acrylics. In one embodiment, both the mounting and rotatable strips 30 and 32 are 11 inches in length and 1½ inches in width. Also, in one embodiment these members together are 3/16 inch thick, with the mounting strip 30 being 1/16 inch thick and the rotatable strip 32 being 2/16 inch thick.

An adhesive surface 48 of the mounting strip 30, which is facing away from the rotatable strip 32, has a pressure sensitive, self-adhering adhesive 50 thereon which, prior to use of the book stiffener mechanism 14, is covered by an adhesive disabling cover 52.

Figure 3:
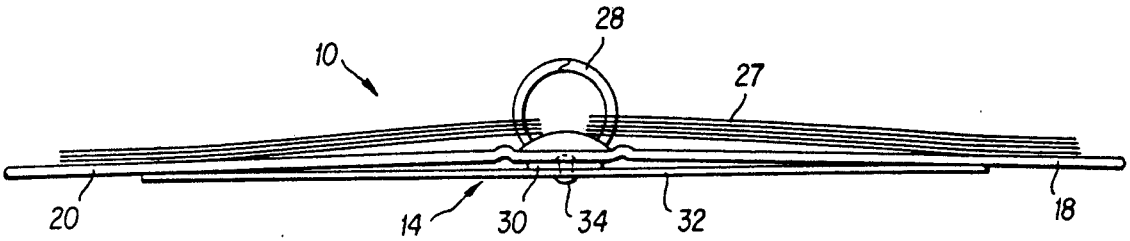
FIG. 3 is a top end view of the structure of FIG. 2.

Describing operation of the stiffened book assembly of FIGS. 1-3, the loose-leaf notebook 12 is constructed separately from the back stiffener mechanism 14. In fact, these items can be sold separately and mated by a user. To mount the back stiffener mechanism 14 on the cover 16, the adhesive disabling cover 52 is removed from the pressure-sensitive adhesive 50 on the adhesive surface 48 and this surface is then pressed firmly against an outside surface 54 of the back binding 22 so as to fixedly attach the mounting strip 30 on the elongated back binding 22, parallel thereto. Once mounted, the rotatable strip 32 can be rotated about the rivet 34, which holds the mounting and rotatable strips 30 and 32 together, between a disabled positioned in which the rotatable strip 32 aligns with the mounting strip 30, as shown in FIG. 1, and a stiffening position in which the rotatable strip 32 is approximately perpendicular to the mounting strip 30, as is depicted in FIG. 2. As can be seen in FIG. 3, when the rotatable strip 32 is in the stiffening position, rear surfaces of the front and rear flap covers 18 and 20 impinge upon outer tips thereof to be held in a fully open position in which they lie approximately in a common plane with each other and also with the back binding 22. In this respect, it can be seen in FIG. 3 that the front and rear flap covers 18 and 20 and the back binding 22 do not lie exactly in the same plane because of the geometry of the various parts, however, they do lie in planes quite close to one another. In this stiffening position the rotatable strip 32 extends across the hinge seams 24 and 26 to thereby impinge upon the front and rear flap covers 18 and 20 when they are in the fully open position to prevent them from being opened substantially beyond a plane of the rotatable strip 32, which is quite close to a common plane in which the front and rear flap covers 18 and 20 and the back binding 22 lie. When it is desired to close the notebook 12 for storing or transporting it, the rotatable strip 32 is rotated to the disabled position shown in FIG. 1 in which it aligns with the mounting strip 30 and the back binding 22 and does not extend beyond the hinge seams 24 and 26 nor extend beyond end edges of the back binding 22. In other words, it is fully out-of-the-way.

Figure 4:
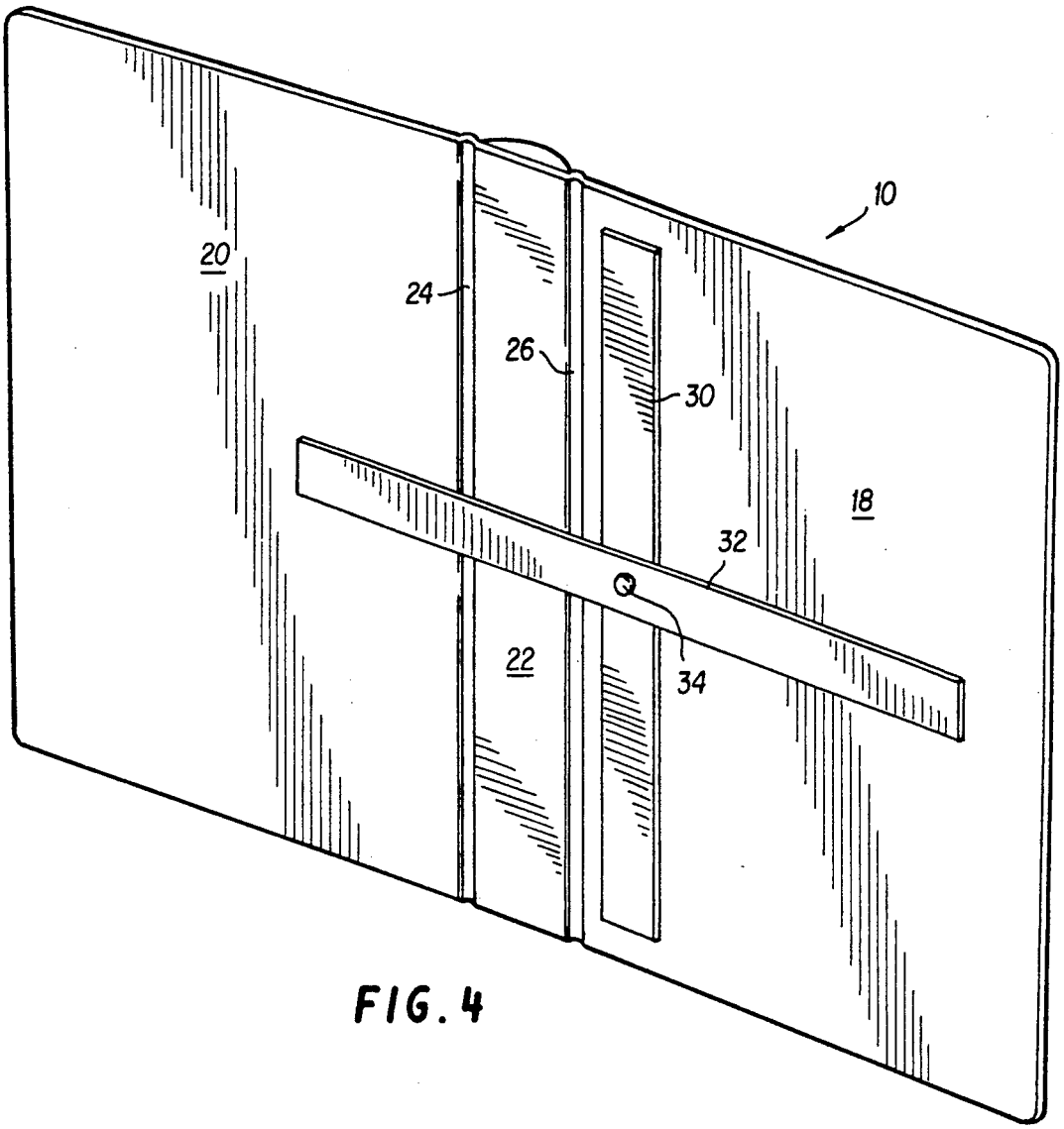
FIG. 4 is an alternate embodiment of the structure of FIGS. 1 and 2, with the book stiffener being mounted at a different location on the book.

Another embodiment similar to the FIGS. 1-3 embodiment is depicted in FIG. 4 in which the mounting strip 30 is not mounted on the back binding 22, but rather, is mounted on a front surface of the front flap cover 18. It can be seen in FIG. 4 that in this configuration the rotatable strip 32 can still be rotated to extend across the hinge seams 24 and 26 so as to impinge on rear surfaces of the front and rear flap covers 18 and 20 for stabilizing or stiffening these flap covers in attitudes in which they are approximately in a common plane.

Figure 5:
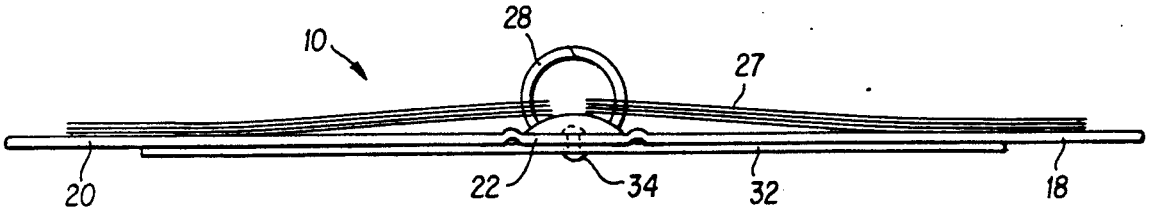
FIG. 5 is a top end view of an alternate embodiment of this invention in which a rotatable strip of a book stiffener is rotatably mounted directly to a back binding of a loose-leaf notebook.

In the embodiment of FIG. 5, the rotatable strip 32 is mounted directly to the back binding 22 by means of the rivet 34 rather than being attached to a mounting strip 30 which is, in turn, attached to the back binding 22. The FIG. 5 embodiment of the invention is normally used when a stiffened book assembly 10 is constructed at a factory and the book stiffener mechanism 14 is not sold separately from the cover 16. Otherwise, the rotatable strip 32 of FIG. 5 functions in the same manner as it functions in the FIGS. 1-3 embodiment with the exception that it tends to stiffen the front and rear flap covers 18 and 20 yet nearer to a common plane since a thickness dimension of the 10 mounting strip 30 is not between the back binding 22 and the rotatable strip 32. It would also be possible to rotatably mount the rotatable strip 32 directly to either the front or rear flap cover 18 or 20 with the rivet 34.

It should be appreciated by those of ordinary skill in the art that the book stiffener mechanism of all the embodiments of the invention are uncomplicated and inexpensive to manufacture but yet provide an extremely useful function of stiffening a loose-leaf notebook, or other book, so that the book can virtually be used as a lap desk. Further, use of a mounting strip in conjunction with a rotatable strip allows a book stiffener mechanism of this invention to be sold separately from a notebook and mated therewith by a user.

By making the mounting strip thinner than the rotatable strip, the rotatable strip can be positioned closer to the back binding 22 and can therefore impinge on the front and rear flap covers 18 and 20 to hold them closer to a plane of the rotatable strip.

Another desirable feature of this invention is that when the rotatable strip is rotated to a disabled position, it does not protrude from a closed notebook on which it is mounted and therefore the stiffened book assembly is not awkward for transportation or storage.

While the invention has been particularly shown and described with reference to a preferred embodiment, it should be understood by those skilled in the art that various changes in form and detail may be made therein without departing from the spirit and scope of the invention. For example, the mounting strip 30 can be shorter than the rotatable strip 32. Also, the adhesive embodiment of FIG. 1 could also be used for constructing a book having the inventive features of this invention in a factory.

The embodiments of the invention in which an exclusive property or privilege are claimed are defined as follows:

I claim:

1. A book stiffener to be attached to a book cover having front and rear flap covers and an elongated book binding for stiffening the book when it is an open configuration, said book stiffener comprising:

a relatively flat, thin, mounting strip including a fixed attachment means for fixedly attaching said mounting strip to an outside surface of the book cover, said mounting strip having a length which is not substantially greater than a height of said book;

an elongated, ridged, rotatable strip having a length dimension substantially greater than a width of said back binding of said book;

a swivel attachment means for attaching said rotatable strip to said mounting strip so as to allow rotation of said rotatable strip relative to said mounting strip;

whereby said mounting strip can be attached to a rear surface of said book cover by said attachment means and said rotatable strip can be rotated to a stiffening position in which it extends across hinge seams of said front and rear flap covers with said back binding to thereby impinge upon the front and rear flap covers to prevent them from being opened substantially beyond a plane of said rotatable strip and to a disabled position in which it extends more nearly parallel with said back binding so as not to substantially extend across hinge seams between said front and rear flap covers.

2. A book stiffener as in claim 1 wherein said fixed attachment means is a pressure-sensitive adhesive on one surface of said mounting means.

3. A book stiffener as in claim 1 wherein said mounting strip is ridged;

4. A book stiffener as in claim 3 wherein said mounting strip is thinner than said rotatable strip.

5. A book stiffener as in claim 4 wherein said mounting strip and said rotatable strip are constructed of the same type of material.

6. A book stiffener as in claim 3 wherein said mounting strip and said rotatable strip are constructed of the same type of material.

7. A book stiffener as in claim 1 wherein said mounting strip and said rotatable strip are both elongated in shape and are both of approximately equal length.

8. A selectively stiffened book comprising:

A book cover having front and rear flap covers respectively rotatably attached to opposite sides of an elongated back binding at seam hinges, said front and rear flap covers being rotatable to a position in which they are almost in a common plane with each other and with the book binding;

A book stiffener mechanism including an elongated, rigid rotatable strip having a length dimension substantially greater than a width dimension of said back binding; Said book stiffener mechanism further comprising a swivel attachment means for attaching said rotatable strip to a rear surface of said book cover so as to allow rotation of said rotatable strip relative to said book cover such that it can be rotated to a stiffening position in which it extends across said hinge seams to thereby impinge upon the front and back flap covers when they are opened to prevent them from being opened substantially beyond said common plane and to a disabled positioned in which it extends, more nearly parallel with said back binding so as not to substantially extend across said hinge seams and also not to extend substantially beyond edges of said book cover.

9. A selectively stiffened book as in claim 8 wherein said rotatable strip is rotatably attached to said back binding and has a width dimension not substantially greater than that of the back binding.

10. A selectively stiffened book as in claim 8 wherein said attachment means attaches said rotatable strip to a rear surface of one of said front or rear flap covers.

11. A selectively stiffened book as in claim 8 wherein said swivel attachment means includes a mounting strip which is rotatably attached to said rotatable strip and which is fixedly attached to said book cover.

12. A selectively stiffened book as in claim 8 wherein said book is a loose-leaf notebook.

13. A method of selectively stiffening a book comprising the steps of:

choosing a book having a cover whose outer surface can be placed close to an approximate common plane when the book is opened; attaching an elongated ridged rotatable strip to the outer surface of the cover of said book with an attachment means for allowing rotation of said rotatable strip about said attachment means; and rotating said rotatable strip between a stiffening position in which it extends across hinge seams of front and back flap covers with an elongated back binding of said cover to thereby impinge upon the front and back flap covers to prevent them from being opened substantially beyond said approximate common plane and a disabled position in which it extends more nearly parallel with said back binding so as not to substantially extend across said hinge seams and not to substantially extend beyond edges of said book cover.

14. A method as in claim 13 wherein said book chosen to be selectively stiffened by said attaching and rotating steps is a loose-leaf notebook.

15. A method as in claim 13 wherein during the attaching step said rotatable strip is attached by said attachment means directly to the back binding of said book.

16. A method as in claim 13 wherein during the attaching step the rotatable strip is attached by said attachment means to a rear surface of one of the front or rear flap covers of the book.

* * * * *